US009972435B2

(12) United States Patent
Nozawa

(10) Patent No.: US 9,972,435 B2
(45) Date of Patent: May 15, 2018

(54) METHOD FOR MANUFACTURING R-T-B BASED SINTERED MAGNET

(71) Applicant: HITACHI METALS, LTD., Tokyo (JP)

(72) Inventor: Noriyuki Nozawa, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days. days.

(21) Appl. No.: 15/128,612

(22) PCT Filed: Mar. 25, 2015

(86) PCT No.: PCT/JP2015/059117
§ 371 (c)(1),
(2) Date: Sep. 23, 2016

(87) PCT Pub. No.: WO2015/147053
PCT Pub. Date: Oct. 1, 2015

(65) Prior Publication Data

US 2017/0117094 A1 Apr. 27, 2017

(30) Foreign Application Priority Data

Mar. 26, 2014 (JP) ..... 2014-063451

(51) Int. Cl.
*H01F 41/02* (2006.01)
*B22F 1/00* (2006.01)
(Continued)

(52) U.S. Cl.
CPC ..... *H01F 41/0266* (2013.01); *B22F 1/0085* (2013.01); *C21D 1/773* (2013.01);
(Continued)

(58) Field of Classification Search
CPC ..... H01F 1/0577; C22C 33/0278
(Continued)

(56) References Cited

U.S. PATENT DOCUMENTS 5,858,124 A 1/1999 Endo et al.
6,797,081 B2 * 9/2004 Hasegawa ..... B22D 13/02 148/101
(Continued)

FOREIGN PATENT DOCUMENTS

CN 102903471 A 1/2013
EP 2 650 887 A2 10/2013
(Continued)

OTHER PUBLICATIONS

International Preliminary Report on Patentability with translation of Written Opinion dated Oct. 6, 2016, issued by the International Searching Authority in Application No. PCT/JP2015/059117.
(Continued)

*Primary Examiner* — Jie Yang
(74) *Attorney, Agent, or Firm* — Sughrue Mion, PLLC

(57) ABSTRACT

Disclosed is a method for manufacturing an R-T-B based sintered magnet, which includes the steps of: preparing an R-T-B based sintered magnet material; and performing a heat treatment by heating the R-T-B based sintered magnet material at a temperature of 450° C. or higher and 470° C. or lower for 4 hours or more and 12 hours or less, wherein the R-T-B based sintered magnet material is represented by the formula of: uRwBxGayCuzAlqM (100−u−w−x−y−z−q) T, the content of RH is 5% or less by mass in the R-T-B based sintered magnet, 29.5≤u≤32.0, 0.86≤w≤0.93, 0.2≤x≤1.0, 0.3≤y≤1.0, 0.05≤z≤0.5, 0≤q≤0.1, and a relationship of p<0 is satisfied when p=[B]/10.811×14−[Fe]/55.847−[Co]/58.933.

6 Claims, 3 Drawing Sheets

(51) Int. Cl.

| | |
|---|---|
| ***C21D 1/773*** | (2006.01) |
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |
| ***C22C 38/00*** | (2006.01) |

(52) U.S. Cl.
CPC ..... *C22C 38/001* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01)

(58) Field of Classification Search
USPC ..... 148/105
See application file for complete search history.

(56) References Cited

U.S. PATENT DOCUMENTS

| | | | | |
|---|---|---|---|---|
| 8,361,242 | B2 * | 1/2013 | Blank | B22F 1/0014 148/101 |
| 2011/0171056 | A1 | 7/2011 | Blank et al. | |
| 2014/0132377 | A1 | 5/2014 | Nakajima et al. | |
| 2015/0170810 | A1 | 6/2015 | Miwa et al. | |

FOREIGN PATENT DOCUMENTS

| | | | |
|---|---|---|---|
| JP | 09-055310 | A | 2/1997 |
| JP | 09-186010 | A | 7/1997 |
| JP | 2003-510467 | A | 3/2003 |
| JP | 2008-264875 | A | 11/2008 |
| JP | 2015-038951 | A | 2/2015 |
| WO | 01/024203 | A1 | 4/2001 |
| WO | 2013/008756 | A1 | 1/2013 |
| WO | 2013/191276 | A1 | 12/2013 |

OTHER PUBLICATIONS

International Search Report for PCT/JP2015/059117 dated May 26, 2015 [PCT/ISA/210].
Written Opinion for PCT/JP2015/059117 dated May 26, 2015 [PCT/ISA/237].
Communication dated Mar. 20, 2017 from the State Intellectual Property Office of the P.R.C. in corresponding Chinese application No. 201580009812.5.
Cheng et al., "The magnetic properties, thermal stability and microstructure of Nd—Fe—B/Ga sintered magnets prepared by blending method", Journal of Magnetism and Magnetic Materials, 2001, vol. 234, No. 2, pp. 274-278 (total 6 pages).
Ragg et al., "A study of the effects of the addition of various amounts of Cu to sintered Nd—Fe—B magnets", Journal of Alloys and Compounds, 1997, vol. 256, Nos. 1-2, pp. 252-257.
Communication dated May 31, 2017 from the German Patent and Trademark Office in corresponding German Application No. 11 2015 001405.5.

* cited by examiner

Composition : $Nd_{23.5}Pr_{7.5}B_{0.92}Ga_{0.5}Cu_{0.13}Al_{0.31}Co_{0.46}Fe_{66}$ (% by mass)

METHOD FOR MANUFACTURING R-T-B BASED SINTERED MAGNET

CROSS REFERENCE TO RELATED APPLICATIONS

This application is a National Stage of International Application No. PCT/JP2015/059117 filed Mar. 25, 2015 (claiming priority based on Japanese Patent Application No. 2014-063451 filed Mar. 26, 2014), the contents of which are incorporated herein by reference in their entirety.

TECHNICAL FIELD

The present invention relates to a method for manufacturing an R-T-B based sintered magnet.

BACKGROUND ART

An R-T-B based sintered magnet (where R is composed of a light rare-earth element RL and a heavy rare-earth element RH, in which RL is Nd and/or Pr, and RH is at least one element of Dy, Tb, Gd, and Ho; and T is a transition metal element, indispensably containing Fe) that contains an $R_2T_{14}B$ type compound as a main phase is known as a magnet with the highest performance among permanent magnets. This type of magnet is used in various motors for hybrid automobiles, electric automobiles, home appliances, etc.

In particular, when used in motors for hybrid automobiles or electric automobiles, the R-T-B based sintered magnet is required to have high coercivity $H_{cJ}$ (hereinafter sometimes simply referred to as "$H_{cJ}$"). Conventionally, to improve the $H_{cJ}$, a heavy rare-earth element (mainly Dy) is added in a large amount to this kind of magnet.

However, the heavy rare-earth elements, especially Dy, have various issues, including inconsistent supply and large fluctuations in price due to minimal abundance and restricted areas where their resources are located, and the like. For this reason, users have recently requested improvement of $H_{cJ}$ in R-T-B based sintered magnets while reducing the use of heavy rare-earth elements, such as Dy, as much as possible with no reduction in $B_r$.

Patent Documents 1 to 3 have proposed that in the R-T-B based sintered magnet, Ga or the like is added while setting a B content lower than the general B content (that is, lower than the B content in a stoichiometric proportion of $R_2T_{14}B$ type compound), thereby achieving the high $H_{cJ}$ with suppression of degradation in $B_r$ while reducing the use of heavy rare-earth elements, such as Dy, as much as possible.

Patent Document 1 mentions that the B content is set lower than that in the standard R-T-B based alloy. Simultaneously, at least one metal element selected from Al, Ga, and Cu is contained to form an $R_2T_{17}$ phase, thus ensuring an adequate volume ratio of a transition-metal-rich phase ($R_6T_{13}M$) that is generated using the $R_2T_{17}$ phase as a raw material. In this way, an R-T-B based rare-earth sintered magnet with high coercivity can be obtained.

Patent Document 2 mentions that an alloy containing Co, Cu, and Ga, yet possessing a boron content lower than the critical boron content in a conventional R-T-B based permanent magnet, exhibits a high coercive force $H_{cJ}$ at the same residual magnetization $B_r$, compared to the conventional alloy.

Patent Document 3 mentions that the contents of B, Al, Cu, Co, Ga, C, and O are set within respective predetermined ranges, while the B content is set lower than that of a standard R-T-B based alloy. Further, an atomic ratio of Nd and Pr to B as well as an atomic ratio of Ga and C to B are respectively set to satisfy specific relationships, whereby high residual flux density and coercivity can be achieved.

Patent Document 1: WO 2013/008756 A
Patent Document 2: JP-2003-510467 W
Patent Document 3: WO 2013/191276 A

DISCLOSURE OF INVENTION

Problems to be Solved by the Invention

The R-T-B based sintered magnet is normally subjected to a heat treatment after sintering in order to attain high $H_{cJ}$. In a heat treatment furnace with a large-sized capacity that is generally used in a production facility, the rate of temperature increase varies depending on the position of the magnet material in the furnace in some cases. When applying the heat treatment to a large amount of R-T-B based sintered magnet materials, the time for each R-T-B based sintered magnet material to reach a heat treatment temperature varies depending on the position at which the sintered magnet raw material is mounted. Additionally, the holding time at the heat treatment temperature is possibly varied according to the mounted position. For example, depending on the structure of the heat treatment furnace and the like, the materials mounted at different positions could experience inconsistent holding times at the heat treatment temperature, which differ by approximately 2 hours. Normally, a holding time for the heat treatment temperature needs about 1 hour. Thus, the holding time (about 1 hour) is required to ensure imparting the high $H_{cJ}$ to even the R-T-B based sintered magnet material mounted in the position, where the rate of temperature increase is low and the holding time at the heat treatment temperature is short. Furthermore, to suppress the fluctuations in $H_{cJ}$ depending on the mounting position, it is consequently necessary to perform the heat treatment for 3 hours or more.

As shown in FIG. 3, the $H_{cJ}$ does not vary significantly even after the heat treatment for 3 hours or more in the general R-T-B based sintered magnet having the B content equal to or more than the stoichiometric proportion of $R_2T_{14}B$ type compound. However, as can be seen from the results of the inventor's study, the $H_{cJ}$ is significantly degraded after the heat treatment for 2 hours or more in a sintered magnet such as that disclosed in Patent Documents 1 to 3. Such a sintered magnet disclosed has the composition in which the B content is lower than that of the general R-T-B based sintered magnet (lower than the B content of the stoichiometric proportion of the $R_2T_{14}B$ type compound), while Ga or the like is added. This phenomenon is not observed in the general R-T-B based sintered magnet as mentioned above. As a result, when large amounts of the sintered magnets with the composition mentioned in Patent Documents 1 to 3 are processed in the heat treatment furnace with the large-sized capacity, the $H_{cJ}$ levels of the sintered magnets mounted at different positions might be varied to a large extent in some cases.

The present invention has been made to solve the above-mentioned problems. It is an object of the present invention to provide a method for manufacturing an R-T-B based sintered magnet that exhibits the high HcJ and suppresses fluctuations in the $H_{cJ}$ due to the heat treatment time even in mass production, while having a composition, such as that mentioned in Patent Documents 1 to 3, that can attain the high $H_{cJ}$ while reducing the use of heavy rare-earth elements, such as Dy, as much as possible; in other words, the composition has Ga or the like added thereto and includes the lower B content than that of the general R-T-B based sintered magnet.

Means for Solving the Problems

A first aspect of the present invention is directed to a method for manufacturing an R-T-B based sintered magnet, which includes the steps of:

preparing an R-T-B based sintered magnet material; and performing a heat treatment by heating the R-T-B based sintered magnet material at a temperature of 450° C. or higher and 470° C. or lower for 4 hours or more and 12 hours or less, wherein the R-T-B based sintered magnet material is represented by the formula of:

uRwBxGayCuzAlqM (100−u−w−x−y−z−q) T (where R is composed of a light rare-earth element RL and a heavy rare-earth element RH, in which RL is Nd and/or Pr, and RH is at least one element of Dy, Tb, Gd, and Ho; T is a transition metal element, indispensably containing Fe; M is Nb and/or Zr; and u, w, x, y, z, q, and 100−u−w−x−y−z−q are expressed in percent by mass), the content of RH is 5% or less by mass in the R-T-B based sintered magnet, $$29.5 \leq u \leq 32.0,$$

$$0.86 \leq w \leq 0.93,$$

$$0.2 \leq x \leq 1.0,$$

$$0.3 \leq y \leq 1.0,$$

$$0.05 \leq z \leq 0.5,$$

$$0 \leq q \leq 0.1, \text{ and}$$

a relationship of $p<0$ is satisfied when $p=[B]/10.811\times14-([Fe]/55.847+[Co]/58.933)$ (where [B], [Fe], and [Co] are contents of B, Fe, and Co in percent by mass, respectively).

A second aspect of the present invention is directed to the method for manufacturing an R-T-B based sintered magnet mentioned in the first aspect, wherein x and y satisfy relationships below:

$$0.3 \leq x \leq 0.7, \text{ and}$$

$$0.5 \leq y \leq 0.7.$$

A third aspect of the present invention is directed to the method for manufacturing an R-T-B based sintered magnet mentioned in the first or second aspect, wherein the heat treatment step is performed by heating the R-T-B based sintered magnet material at a temperature of 450° C. or higher and 470° C. or lower for 4 hours or more and 8 hours or less.

Effects of the Invention

The present invention can provide a method for manufacturing an R-T-B based sintered magnet that exhibits the high $H_{cJ}$ and suppresses fluctuations in the $H_{cJ}$ due to the heat treatment time in mass production, while having the composition with Ga or the like added thereto and having the lower B content than that of the general R-T-B based sintered magnet as mentioned in Patent Documents 1 to 3.

MODE FOR CARRYING OUT THE INVENTION

Figure 1:
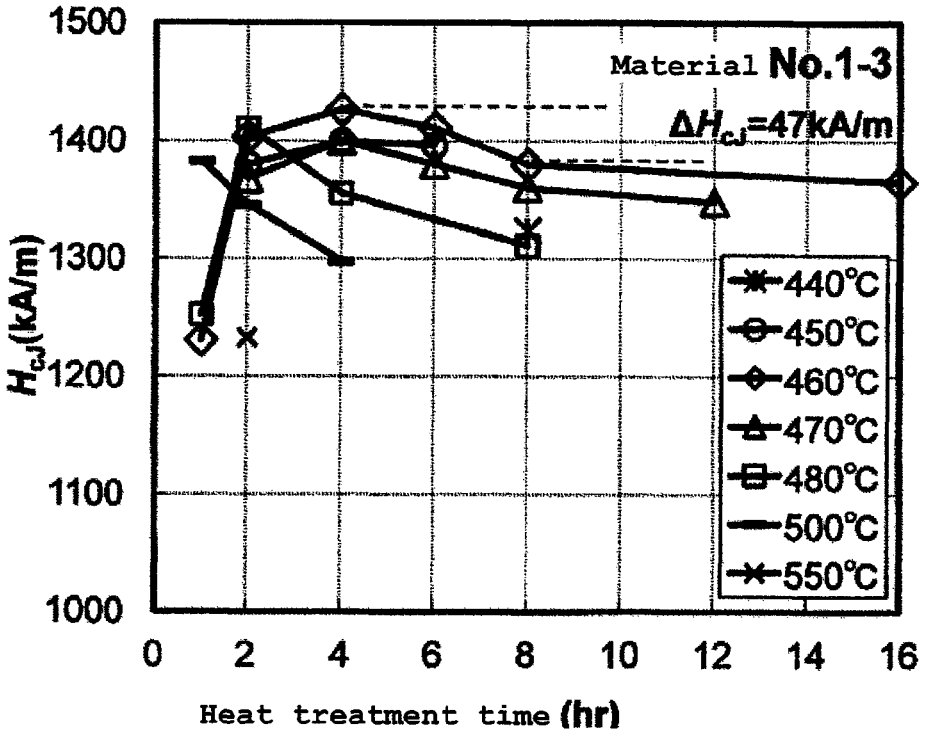
FIG. 1 is an explanatory diagram showing a relationship between $H_{cJ}$ of an R-T-B based sintered magnet of specimen No. 1-3 and the heat treatment time.

The inventors have intensively studied to solve the above-mentioned problems and have found that an R-T-B based sintered magnet exhibiting the high $H_{cJ}$ while suppressing fluctuations in the $H_{cJ}$ during a heat treatment in mass production can be manufactured as mentioned in the first aspect of the present invention by the following method: by setting the Cu content to 0.3 to 1.0% by mass, and performing the heat treatment at a temperature of 450° C. or higher and 470° C. or lower for 4 hours or more and 12 hours or less, on a composition with Ga or the like added thereto and a B content that is smaller than that of a general R-T-B based sintered magnet equal to or more than the stoichiometric proportion of an $R_2T_{14}B$-type compound.

Patent Document 1 mentions that the heat treatment is performed on a sintered magnet with a composition having a Cu content of 0 to 0.31% by mass in two stages at 800° C. and 500° C., but fails to mention a heat treatment time. In the technique mentioned in Patent Document 2, a sintered magnet with a composition having a Cu content of 0.1 to 0.19% by mass is subjected to a heat treatment at 440° C. to 550° C. for one to 2 hours based on a heat treatment pattern shown in FIGS. 3 and 4 of Patent Document 2. However, as mentioned above, since the heat treatment time is so short, for example, 1 to 2 hours, that the $H_{cJ}$ of the sintered magnet can vary significantly depending on the mounted position when using a heat treatment furnace with a large-sized capacity that is commonly used in the production facility.

Further, in the technique mentioned in Patent Document 3, in Examples, a sintered magnet with a composition having a Cu content of 0.6% by mass is subjected to a heat treatment at 850° C. for 1 hour and at 540° C. for 2 hours. However, the above-mentioned heat treatment temperatures are not considered to be optimal temperatures for the composition, and thus the high $H_{cJ}$ cannot be obtained. Further, the $H_{cJ}$ of the sintered magnet may vary significantly depending on the mounted position thereof when using the heat treatment furnace with the large-sized capacity that is commonly used in the production facility.

The present invention will be described below. In the description below, an R-T-B based sintered magnet before a heat treatment is referred to as an "R-T-B based sintered magnet material"; and an R-T-B based sintered magnet after the heat treatment is simply referred to as an "R-T-B based sintered magnet".

[Preparation Step of R-T-B Based Sintered Magnet Material]

In a step of preparing an R-T-B based sintered magnet material, respective metals or alloys are first prepared such that the R-T-B based sintered magnet material has the composition to be mentioned in detail below, and subsequently the prepared metals or alloys are processed by a strip casting method or the like to thereby fabricate a flake raw-material alloy. Then, the flake raw-material alloy is produced into alloy powder, followed by molding and sintering the alloy powder, thereby producing an R-T-B based sintered magnet material. The production, molding, and sintering of the alloy powder are performed by way of example as follows. The obtained flake raw-material alloy is subjected to hydrogen pulverization, thereby producing rough pulverized powder having a size of, e.g. 1.0 mm or less. Then, the rough pulverized powder is further pulverized finely by a jet mill or the like in an inert gas, thereby producing fine pulverized powder (alloy powder) having a particle size $D_{50}$ of 3 to 5 μm (which is a volume central value (volume-based median diameter) obtained by measurement using an airflow dispersion laser diffraction method). The alloy powder may be one kind of alloy powder (single alloy powder), or a mixture of two or more kinds of alloy powders (mixed alloy powder) obtained by the so-called two-alloy method. The alloy powder may be fabricated by any well-known method to have the composition of the present invention. A well-known lubricant may be respectively added as an auxiliary agent to the rough pulverized powder before the jet mill pulverization, or the alloy powder during or after the jet mill pulverization. Then, the thus-obtained alloy powder is molded in a magnetic field, thereby producing a molded body. The molding may be performed by any well-known molding methods. The molding methods include a dry molding method and a wet molding method. In the dry molding method, dry alloy powder is inserted into a cavity of a die and pressed. In the wet molding method, a slurry containing a dispersion medium and alloy powder dispersed in the dispersion medium is charged into a cavity of a mold, thereby executing molding while discharging the dispersion medium of the slurry. Such a molded body is sintered to produce the R-T-B sintered magnet material. Sintering of the molded body can be done by the well-known methods. Note that to prevent oxidization in an atmosphere during the sintering, the sintering is preferably performed in a vacuum atmosphere or atmosphere gas. The atmosphere gas preferably uses inert gases, such as helium or argon.

Note that although in the above-mentioned description, the method for obtaining the alloy powder using the flake raw-material alloy has been explained, any raw-material alloy in an arbitrary form, which includes a casting material with any shape other than the flake, may be used instead of the flake raw-material alloy.

The composition of the R-T-B based sintered magnet material in the present invention is represented by formula (1) below:

$$uRwBxGayCuzAlqM(100-u-w-x-y-z-q)T \quad (1)$$

(where R is composed of a light rare-earth element RL and a heavy rare-earth element RH, in which RL is Nd and/or Pr, and RH is at least one element of Dy, Tb, Gd, and Ho; T is a transition metal element, indispensably containing Fe; and M is Nb and/or Zr, and where u, w, x, y, z, q, and 100−u−w−x−y−z−q are expressed in percent by mass), the content of RH is 5% or less by mass in the R-T-B based sintered magnet, $$29.5 \le u \le 32.0 \quad (2)$$

$$0.86 \le w \le 0.93 \quad (3)$$

$$0.2 \le x \le 1.0 \quad (4)$$

$$0.3 \le y \le 1.0 \quad (5)$$

$$0.05 \le z \le 0.5 \quad (6)$$

$$0 \le q \le 0.1 \quad (7), \text{ and}$$

$$\text{when } p=[B]/10.811\times14-([Fe]/55.847+[Co]/58.933) \quad (8),$$

$$\text{a relationship of } p<0 \quad (9)$$

is satisfied (where [B], [Fe], and [Co] are contents of B, Fe, and Co in percentage by mass, respectively).

The R-T-B based sintered magnet of the present invention can contain inevitable impurities. Even if the R-T-B based sintered magnet contains inevitable impurities normally trapped in, for example, a didymium alloy (Nd—Pr), an electrolytic iron, ferro-boron, etc., the effects of the present invention can also be exhibited. The inevitable impurities can include, for example, La, Ce, Cr, Mn, Si, etc.

With the above-mentioned composition, the B content is set lower than that of the general R-T-B based sintered magnet, and further Ga or the like is contained, whereby an R-T-Ga phase (and an R-T-Ga—Cu phase) is generated in grain boundaries, like in Patent Documents 1 to 3 mentioned above. Consequently, the R-T-B based sintered magnet material can achieve the high $H_{cJ}$ while reducing the use of the heavy rare-earth element, such as Dy, as much as possible.

In the formula (1) mentioned above, as can be seen from the representation of the T content by the formula of "(100−u−w−x−y−z−q)", the contents of inevitable impurities (inevitable impurities except for Al) are included in the T content. The determination on whether the formulas (1) to (7) are satisfied or not in the present invention may be made by measuring the respective contents of R, B, Ga, Cu, Al, and M (Nb and Zr) using a high-frequency inductively coupled plasma optical emission spectrometry (ICP-OES) method to thereby determine the values of u, w, x, y, z, and q, and then determining a T content by the formula "100−u−w−x−y−z−q". The determination on whether the formulas (8) and (9) are satisfied or not may be made by measuring the contents of B, Fe, and Co using the high-frequency inductively coupled plasma optical emission spectrometry (ICP-OES).

R of the R-T-B based sintered magnet in the present invention is composed of a light rare-earth element RL and a heavy rare-earth element RH; RL is Nd and/or Pr (that is, RL means Nd and Pr, and the R-T-B based sintered magnet in the present invention may contain at least one of Nd and Pr); and RH is at least one element of Dy, Tb, Gd, and Ho (that is, RH means Dy, Tb, Gd and Ho, and the R-T-B based sintered magnet in the present invention may contain at least one element of Dy, Tb, Gd, and Ho.) An RH content is set at 5% or less by mass in the R-T-B based sintered magnet. The invention can achieve the high $B_r$ and $H_{cJ}$ without using the heave rare-earth element. Even when the higher $H_{cJ}$ is required, the amount of added RH can be reduced, typically to 2.5% or less by mass. When the R content (u) is less than 29.5% by mass, a liquid phase in the sintering becomes lacking and thereby the sintered magnet cannot be made dense sufficiently, failing to achieve the high $B_r$. When the R content exceeds 32.0% by mass, the ratio of a main phase in the total magnet decreases, failing to achieve the high $B_r$. The R content is preferably 30.0% by mass or more and 31.5% by mass or less. T is a transition metal element and indispensably contains Fe. The transition metals other than Fe can include, for example, Co. Note that the amount of replacement of Co is preferably 2.5% or less by mass. When the amount of replacement (i.e., the content) of Co exceeds 10% by mass, $B_r$ is degraded, which is not preferable. Furthermore, a small amount of V, Cr, Mn, Mo, Hf, Ta, W, etc. may be contained as the transition metals. B means boron, and the B content is set at 0.86% by mass or more and 0.93% by mass or less. When the B content (w) is less than 0.86% by mass, $R_2T_{17}$ phase is precipitated, failing to achieve the high $H_{cJ}$, and reducing the ratio of the main phase, failing to achieve the high $B_r$. When the B content exceeds 0.93% by mass, the ratio of the R-T-Ga phase is decreased, thus failing to obtain the high $H_{cJ}$. The B content is preferably 0.88% by mass or more and 0.91% by mass or less.

The Ga content (x) is set at 0.2% by mass or more and 1.0% by mass or less. When the Ga content is less than 0.2% by mass, the amount of formed R-T-Ga phase is too small to diminish the $R_2T_{17}$ phase, whereby the sintered magnet might not possibly achieve the high $H_{cJ}$. When the Ga content exceeds 1.0% by mass, unnecessary Ga is present, and thereby the ratio of the main phase might be decreased, leading to the reduction in $B_r$. The Ga content is preferably 0.3% by mass or more and 0.7% by mass or less.

The Cu content (y) is set at 0.3% by mass or more and 1.0% by mass or less. The Cu content is set within a range specified by the present invention, and the heat treatment is performed at temperatures in a specific range and for the duration in a specific range to be mentioned later, whereby fluctuations in $H_{cJ}$ due to the heat treatment time can be suppressed. When the Cu content (y) is less than 0.3% by mass, fluctuations in $H_{cJ}$ due to the heat treatment time cannot be suppressed. When using the heat treatment furnace having the large-sized capacity commonly used in the production facility as mentioned above, the $H_{cJ}$ of the R-T-B based sintered magnet changes significantly depending on the mounted position. When the Cu content exceeds 1.0% by mass, unnecessary Cu is present, and thereby the ratio of the main phase might be decreased, leading to the reduction in $B_r$. The Cu content is preferably 0.5% by mass or more and 0.7% by mass or less.

The Al content (z) is set at 0.05% by mass or more and 0.5% by mass or less. The R-T-B based sintered magnet contains Al, thereby enabling improvement of $H_{cJ}$. Al may be contained as an inevitable impurity, or alternatively may be positively added. The total amount of Al contained as the inevitable impurity and positively added is set at 0.05% by mass or more and 0.5% by mass or less.

In general, the R-T-B based sintered magnet is known to suppress the abnormal grain growth of crystal grains during sintering by containing Nb and/or Zr. Also, the R-T-B based sintered magnet in the present invention may contain 0.1% or less by mass in total of Nb and/or Zr (that is, may contain at least one of Nb and Zr, and the total content of Nb and Zr is set at 0.1% or less by mass). When the total content of Nb and/or Zr exceeds 0.1% by mass, unnecessary Nb and Zr are present, and thereby the ratio of the main phase might be decreased, leading to the reduction in $B_r$.

Figure 3:
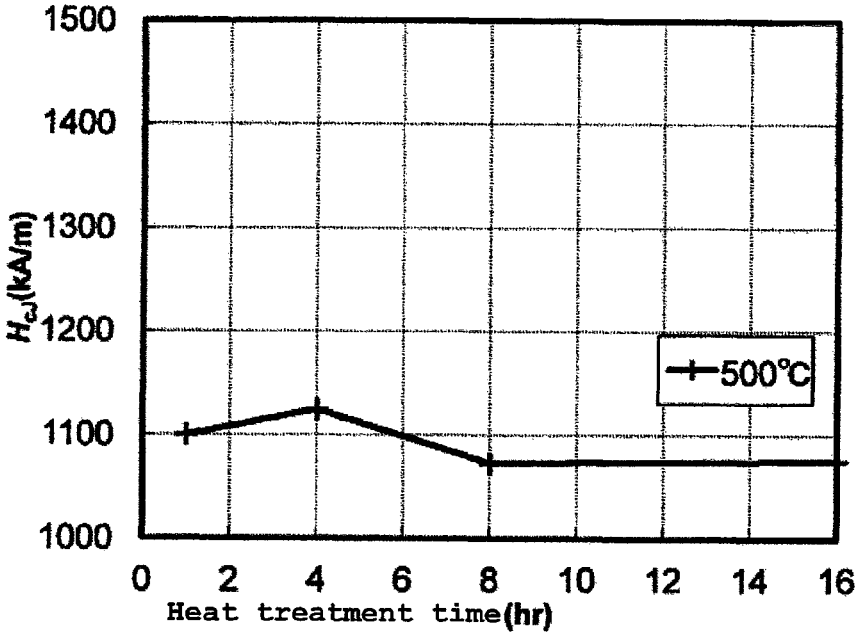
FIG. 3 is an explanatory diagram showing a relationship between $H_{cJ}$ of an R-T-B based sintered magnet having a standard B content and the heat treatment time.

Further, in the composition of the R-T-B based sintered magnet material in the present invention, the B content is set lower than that of the general R-T-B based sintered magnet. The general R-T-B based sintered magnet is designed to have the composition in which ([B]/10.811 (atomic weight of B)×14) is not less than ([Fe]/55.847 (atomic weight of Fe)+[Co]/58.933 (atomic weight of Co)) in order to prevent the precipitation of a soft magnetic phase of $R_2T_{17}$ phase other than the main phase of $R_2T_{14}B$ phase. Unlike the general R-T-B based sintered magnet, the R-T-B based sintered magnet in the present invention is configured to have the composition in which ([B]/10.811 (atomic weight of B)×14) is less than ([Fe]/55.847 (atomic weight of Fe)+[Co]/58.933 (atomic weight of Co)), that is, in which $p<0$ when $p=[B]/10.811\times14-[Fe]/55.847-[Co]/58.933$ (where [B], [Fe], and [Co] indicate the contents of B, Fe, and Co, respectively, in percentage by mass). Furthermore, the R-T-B based sintered magnet in the present invention is configured to contain Ga and Cu to thereby precipitate an R-T-Ga phase, an R—Ga phase, and/or an R—Ga—Cu phase. With this arrangement, the R-T-B based sintered magnet in the present invention can achieve the high $H_{cJ}$ while reducing the use of the heavy rare-earth element, such as Dy, as much as possible. Note that the composition shown in FIG. 3 is designed such that ([B]/10.811 (atomic weight of B)×14) is not less than ([Fe]/55.847 (atomic weight of Fe)+[Co]/58.933 (atomic weight of Co)) (i.e. $p>0$).

In the R-T-Ga phase of the present invention, the R content is set at 15% by mass or more and 65% by mass or less; the T content is set at 20% by mass or more and 80% by mass or less; and the Ga content is set at 2% by mass or more and 20% by mass or less. The R-T-Ga phase is made of a compound typically having a $La_6Co_{11}Ga_3$ type crystal structure, specifically, an $R_6T_{13-\alpha}Ga_{1+\alpha}$ compound. Note that when the R-T-B based sintered magnet contains Al, Cu, and Si, the R-T-Ga phase can be made of an $R_6T_{13}(Ga_{1-x-y-z}Cu_xAl_ySi_z)_{1+\alpha}$ compound.

[Heat Treatment Step]

The thus-obtained R-T-B based sintered magnet material is heated at a temperature of 450° C. or higher and 470° C. or lower for 4 hours or more and 12 hours or less. By performing the heat treatment within the range specified by the present invention, the high $H_{cJ}$ can be achieved, and fluctuations in $H_{cJ}$ due to the heat treatment time can be suppressed. If the heat treatment temperature and time deviates from the ranges specified by the present invention, the high $H_{cJ}$ will not be able to be achieved, or the heat treatment will become extremely long, resulting in degradation in the productivity. In particular, when the heat treatment time is less than 4 hours, the $H_{cJ}$ might vary depending on the mounted position in the heat treatment furnace, and thereby the high $H_{cJ}$ might not possibly be achieved. When the heat treatment time exceeds 8 hours, the production efficiency might be degraded more, and further the $H_{cJ}$ might be degraded. Thus, the heat treatment time is preferably set at 4 hours or more and 8 hours or less. This is because a fluctuation range of $H_{cJ}$ due to the heat treatment time can be further suppressed to achieve the higher $H_{cJ}$.

Preferably, the R-T-B based sintered magnet material before the heat treatment step is subjected to a heating process at a temperature of 600° C. or higher and 1,020° C. or lower, followed by the above-mentioned heat treatment step. The heating process can be performed to achieve the higher $H_{cJ}$.

Further, the heating process and the above-mentioned heat treatment step may be continuously performed after the sintering. For example, the molded body may be sintered at 1,100° C., then cooled to 460° C., and subsequently subjected to the heat treatment step while being kept at 460° C. for 6 hours. Alternatively, the molded body may be sintered at 1,100° C., then cooled to 800° C., and subsequently subjected to the heating process while being kept at 800° C. for 2 hours, followed by cooling to 460° C. and subsequently executing the heat treatment step while being kept at 460° C. for 6 hours.

The thus-obtained sintered magnet may be subjected to machining, such as grinding, to adjust the size of the magnet. In this case, the heat treatment may be performed either before or after the machining. Further, such a sintered magnet obtained may be subjected to a surface treatment.

The surface treatment may be the well-known surface treatment. For example, Al vapor deposition, Ni electroplating, or resin coating, can be performed as the surface treatment.

EXAMPLES

Examples of the embodiments in the present invention will be described below, but the present invention is not limited thereto.

Test Example 1

An Nd metal, a Pr metal, an electrolytic Co, an Al metal, a Cu metal, a Ga metal, an electrolytic iron (each of these metals having a purity of 99% or more), and a ferro-boron alloy were blended in such a manner as to have a sintered composition shown in Table 1. These raw materials were melted and casted by the strip cast method, thereby producing a flake raw-material alloy having a thickness of 0.2 to 0.4 mm. The thus-obtained flake raw-material alloy was subjected to hydrogen embrittlement under a hydrogen pressurized atmosphere, and a dehydrogenation process was performed on the alloy by heating to 550° C. in vacuum and cooling, thereby producing rough pulverized powder. Then, 0.04% by mass of zinc stearate was added as a lubricant and mixed into 100% by mass of the rough pulverized powder obtained, followed by dry pulverization under a gas flow of nitrogen gas using the gas-flow pulverizer (jet mill device), thereby producing fine pulverized powder (alloy powder) having a grain size $D_{50}$ of 4.0 to 4.6 μm. Note that in this study, the oxygen concentration in the nitrogen gas during the pulverization was set to 50 ppm or less, whereby the amount of oxygen in the sintered magnet finally obtained was set to around 0.1% by mass. The grain size $D_{50}$ is a volume-center value (volume-based median diameter) obtained by measurement using the gas flow dispersion laser diffraction method.

The fine pulverized powder was dispersed in oil to fabricate a slurry. The slurry was charged into a cavity of a mold, and then was molded by the wet molding method while discharging the oil, thereby producing a molded body. The molding device was a so-called perpendicular magnetic field molding device (transverse magnetic field molding device) in which a magnetic-field application direction is perpendicular to a pressurizing direction.

After performing a deoiling process on the obtained molded body, the molded body was sintered at a temperature of 1,040 to 1,070° C. for 4 hours in vacuum, followed by rapid cooling, thereby producing the R-T-B based sintered magnet material. The density of the R-T-B based sintered magnet material was 7.5 $Mg/m^3$ or more. Table 1 shows the contents of respective components of the obtained R-T-B based sintered magnet material as well as the results thereof by gas analysis (O (oxygen), N (nitrogen), and C (carbon)). Note that the contents of the respective components shown in Table 1 were determined by measurement by use of the high-frequency inductively coupled plasma optical emission spectrometry (ICP-OES). Further, the O (oxygen) content was measured by a gas analyzer using a gas fusion infrared absorption method; the N (nitrogen) content was measured by a gas analyzer using a gas fusion thermal conductivity method; and the C (carbon) content was measured by a gas analyzer using a combustion infrared adsorption method. Moreover, the total content of Nd and Pr as shown in Table 1 is an R content (u). The same shall apply to all of the following tables. Although Table 1 does not mention "q", the total content of Nb and Zr is an M content (q) (the same shall apply to the following Tables 7, 13, and 19).

TABLE 1

| Material | Component [% by mass] | | | | | | | | | | | Oxygen-Nitrogen-Carbon [% by mass] | | | Calculated value |
|---|---|---|---|---|---|---|---|---|---|---|---|---|---|---|---|
| No. | Nd | Pr | R u | B w | Ga x | Cu y | Al z | Nb | Zr | Co | Fe | O | N | C | p |
| 1-1 | 23.4 | 7.7 | 31.1 | 0.90 | 0.3 | 0.09 | 0.29 | 0.00 | 0.00 | 0.50 | 66.3 | 0.10 | 0.04 | 0.09 | −0.026 |
| 1-2 | 23.2 | 7.7 | 30.9 | 0.90 | 0.3 | 0.30 | 0.29 | 0.00 | 0.00 | 0.50 | 66.2 | 0.10 | 0.05 | 0.09 | −0.027 |
| 1-3 | 23.3 | 7.7 | 31.0 | 0.90 | 0.3 | 0.51 | 0.29 | 0.00 | 0.00 | 0.50 | 66.2 | 0.09 | 0.04 | 0.09 | −0.026 |
| 1-4 | 23.2 | 7.7 | 30.9 | 0.90 | 0.3 | 0.72 | 0.29 | 0.00 | 0.00 | 0.50 | 66.1 | 0.10 | 0.05 | 0.09 | −0.033 |
| 1-5 | 22.9 | 7.5 | 30.4 | 0.89 | 0.3 | 1.00 | 0.29 | 0.00 | 0.00 | 0.50 | 65.1 | 0.10 | 0.05 | 0.09 | −0.020 |

The obtained R-T-B based sintered magnet material was heated, held at 800° C. for 2 hours in vacuum, and then cooled to the room temperature. Then, the R-T-B based sintered magnet material was subjected to a heat treatment on the conditions mentioned in one of Tables 2 to 6 in vacuum, and subsequently cooled to the room temperature. That is, a material No. 1-1 was subjected to the heat treatment under the heat treatment conditions (heat treatment temperature, heat treatment time) shown in Table 2; a material No. 1-2 was subjected in the same way under the heat treatment conditions shown in Table 3; and materials No. 1-3 to 1-5 were subjected in the same way under the heat treatment conditions shown in Tables 4 to 6, respectively. At this time, the heat treatment on the conditions mentioned in Tables 2 to 6 was performed in a heat treatment furnace for experiments having a small capacity, so that delay of the specimen's temperature hardly occurred during the increase in temperature. Thus, the heat treatment time mentioned in the tables corresponds to a time during which the R-T-B based sintered magnet material was actually held at the heat treatment temperature. Then, the R-T-B based sintered magnet after the heat treatment was machined to fabricate specimens having 7 mm length, 7 mm width, and 7 mm thickness. Each specimen of the material was magnetized by a pulse magnetic field of 3.2 MA/m, and then the $B_r$ and $H_{cJ}$ of each specimen was measured by a B—H tracer. The results of measurements are shown in Tables 2 to 6. It was analyzed and confirmed by the high-frequency inductively coupled plasma optical emission spectrometry (ICP-OES) method that the composition of the R-T-B based sintered magnet obtained after the heat treatment was the same (substantially the same) as the composition of the R-T-B based sintered material shown in Table 1.

Further, a fluctuation range of $H_{cJ}$ in each of Table 2 (material No. 1-1) to Table 6 (material No. 1-5) was determined. The fluctuation range of $H_{cJ}$ was determined as follows. Among the heat treatment temperatures and heat treatment times in each table (each material No.), the optimal temperature and time at which $H_{cJ}$ was the highest were first defined as the standard. Next, among the heat treatment times of 4 hours to 12 hours at the optimal temperature, a difference between the $H_{cJ}$ defined as the standard and the lowest $H_{cJ}$ was determined, whereby such a difference was defined as a fluctuation range of $H_{cJ}$. Such a difference was indicated by $\Delta H_{cJ}$ in Table. Note that in each test example below, the experiment was not performed for all heat treatment times ranging from 4 to 12 hours. Among the results of measurements for each material through the experiments at the time ranging from 4 to 12 hours, the lowest $H_{cJ}$ was used, whereby a difference between the lowest $H_{cJ}$ and the standard $H_{cJ}$ was determined. For example, in Table 2 (material No. 1-1), the optimal temperature and time at which the $H_{cJ}$ was the highest corresponded to Comparative Example 7 (1,450 kA/m). With the temperature (480° C.) in Comparative Example 7 defined as the standard, the lowest $H_{cJ}$ in the range of the heat treatment times from 4 hours to 12 hours at the same temperature as in Comparative Example 7 corresponded to Comparative Example 8 (heat treatment time: 4 hours, $H_{cJ}$: 1360 kA/m). By calculating a difference between the $H_{cJ}$ in Comparative Example 8 and the standard $H_{cJ}$ (in Comparative Example 7), the fluctuation range of $H_{cJ}$ was 90 kA/m. Likewise, the fluctuation range of $H_{cJ}$ in each of Table 3 (material No. 1-2) to Table 6 (material No. 1-5) was determined. For reference, Examples and Comparative Examples used to determine the fluctuation range of $H_{cJ}$ were underlined. In the present invention, the fluctuation range of $H_{cJ}$ of 60 kA/m or less is defined as a range with no problem in terms of productivity because this level of the fluctuation range of $H_{cJ}$ is considered to be suppressed in the present invention.

TABLE 2

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 1 | 1-1 | 440 | 8 | 1.36 | 1208 | |
| Comparative Example 2 | 1-1 | 460 | 2 | 1.36 | 1389 | |
| Comparative Example 3 | 1-1 | 460 | 4 | 1.36 | 1332 | |
| Comparative Example 4 | 1-1 | 460 | 6 | 1.35 | 1301 | |
| Comparative Example 5 | 1-1 | 460 | 8 | 1.36 | 1260 | |
| Comparative Example 6 | 1-1 | 480 | 1 | 1.36 | 1394 | |
| Comparative Example 7 | 1-1 | 480 | 2 | 1.36 | 1450 | 90 |
| Comparative Example 8 | 1-1 | 480 | 4 | 1.36 | 1360 | |
| Comparative Example 9 | 1-1 | 500 | 1 | 1.36 | 1443 | |
| Comparative Example 10 | 1-1 | 500 | 2 | 1.36 | 1414 | |
| Comparative Example 11 | 1-1 | 500 | 4 | 1.35 | 1381 | |
| Comparative Example 12 | 1-1 | 500 | 6 | 1.35 | 1321 | |
| Comparative Example 13 | 1-1 | 500 | 8 | 1.35 | 1269 | |
| Comparative Example 14 | 1-1 | 500 | 2 | 1.35 | 1307 | |

TABLE 3

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 15 | 1-2 | 440 | 8 | 1.36 | 1309 | |
| Comparative Example 16 | 1-2 | 460 | 2 | 1.36 | 1421 | 57 |
| Example 1 | 1-2 | 460 | 4 | 1.35 | 1420 | |
| Example 2 | 1-2 | 460 | 6 | 1.35 | 1397 | |
| Example 3 | 1-2 | 460 | 8 | 1.35 | 1364 | |
| Comparative Example 17 | 1-2 | 480 | 1 | 1.36 | 1241 | |
| Comparative Example 18 | 1-2 | 480 | 2 | 1.36 | 1419 | |
| Comparative Example 19 | 1-2 | 480 | 4 | 1.35 | 1356 | |
| Comparative Example 20 | 1-2 | 480 | 8 | 1.35 | 1301 | |
| Comparative Example 21 | 1-2 | 500 | 1 | 1.35 | 1431 | |
| Comparative Example 22 | 1-2 | 500 | 2 | 1.36 | 1364 | |
| Comparative Example 23 | 1-2 | 500 | 2 | 1.35 | 1239 | |

TABLE 4

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 24 | 1-3 | 440 | 8 | 1.35 | 1324 | |
| Comparative Example 25 | 1-3 | 450 | 2 | 1.36 | 1265 | |
| Example 4 | 1-3 | 450 | 4 | 1.35 | 1380 | |
| Example 5 | 1-3 | 450 | 6 | 1.35 | 1400 | |
| Example 6 | 1-3 | 450 | 8 | 1.35 | 1396 | |
| Comparative Example 26 | 1-3 | 460 | 1 | 1.36 | 1231 | |
| Comparative Example 27 | 1-3 | 460 | 2 | 1.36 | 1403 | |
| Example 7 | 1-3 | 460 | 4 | 1.35 | 1427 | 47 |
| Example 8 | 1-3 | 460 | 6 | 1.35 | 1411 | |
| Example 9 | 1-3 | 460 | 8 | 1.35 | 1380 | |
| Comparative Example 28 | 1-3 | 460 | 16 | 1.35 | 1365 | |
| Comparative Example 29 | 1-3 | 470 | 2 | 1.36 | 1368 | |
| Example 10 | 1-3 | 470 | 4 | 1.35 | 1400 | |

TABLE 4-continued

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Example 11 | 1-3 | 470 | 6 | 1.35 | 1380 | |
| Example 12 | 1-3 | 470 | 8 | 1.35 | 1360 | |
| Example 13 | 1-3 | 470 | 12 | 1.35 | 1348 | |
| Comparative Example 30 | 1-3 | 480 | 1 | 1.36 | 1253 | |
| Comparative Example 31 | 1-3 | 480 | 2 | 1.35 | 1411 | |
| Comparative Example 32 | 1-3 | 480 | 4 | 1.35 | 1355 | |
| Comparative Example 33 | 1-3 | 480 | 8 | 1.35 | 1311 | |
| Comparative Example 34 | 1-3 | 500 | 1 | 1.35 | 1383 | |
| Comparative Example 35 | 1-3 | 500 | 2 | 1.35 | 1346 | |
| Comparative Example 36 | 1-3 | 500 | 4 | 1.35 | 1298 | |
| Comparative Example 37 | 1-3 | 500 | 2 | 1.35 | 1233 | |

TABLE 5

| | Material No. | Heat treatment temperature [° C.] | Heat treatment time [Time] | Br [T] | $H_{cJ}$ [kA/m] | $\Delta H_{cJ}$ [kA/m] |
|---|---|---|---|---|---|---|
| Comparative Example 38 | 1-4 | 440 | 8 | 1.34 | 1,361 | |
| Comparative Example 39 | 1-4 | 460 | 2 | 1.35 | 1,391 | |
| Example 14 | 1-4 | 460 | 4 | 1.34 | 1,431 | 17 |
| Example 15 | 1-4 | 460 | 6 | 1.34 | 1,429 | |
| Example 16 | 1-4 | 460 | 8 | 1.34 | 1,414 | |
| Comparative Example 40 | 1-4 | 460 | 16 | 1.34 | 1,389 | |
| Comparative Example 41 | 1-4 | 480 | 1 | 1.35 | 1,298 | |
| Comparative Example 42 | 1-4 | 480 | 2 | 1.35 | 1,397 | |
| Comparative Example 43 | 1-4 | 480 | 4 | 1.33 | 1,353 | |
| Comparative Example 44 | 1-4 | 500 | 1 | 1.35 | 1,362 | |
| Comparative Example 45 | 1-4 | 500 | 2 | 1.35 | 1,338 | |
| Comparative Example 46 | 1-4 | 500 | 4 | 1.34 | 1,321 | |
| Comparative Example 47 | 1-4 | 500 | 8 | 1.33 | 1,289 | |
| Comparative Example 48 | 1-4 | 500 | 2 | 1.35 | 1,233 | |

TABLE 6

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 49 | 1-5 | 440 | 8 | 1.34 | 1379 | |
| Example 17 | 1-5 | 450 | 4 | 1.33 | 1401 | |
| Example 18 | 1-5 | 450 | 6 | 1.34 | 1433 | |
| Example 19 | 1-5 | 450 | 8 | 1.33 | 1429 | |
| Comparative Example 50 | 1-5 | 460 | 2 | 1.34 | 1351 | |
| Example 20 | 1-5 | 460 | 4 | 1.33 | 1457 | 23 |
| Example 21 | 1-5 | 460 | 6 | 1.33 | 1444 | |
| Example 22 | 1-5 | 460 | 8 | 1.33 | 1434 | |
| Comparative Example 51 | 1-5 | 460 | 16 | 1.33 | 1411 | |
| Example 23 | 1-5 | 470 | 4 | 1.33 | 1438 | |
| Example 24 | 1-5 | 470 | 6 | 1.33 | 1417 | |
| Example 25 | 1-5 | 470 | 8 | 1.33 | 1420 | |
| Comparative Example 52 | 1-5 | 480 | 1 | 1.34 | 1251 | |
| Comparative Example 53 | 1-5 | 480 | 2 | 1.34 | 1369 | |
| Comparative Example 54 | 1-5 | 480 | 4 | 1.33 | 1360 | |
| Comparative Example 55 | 1-5 | 500 | 1 | 1.34 | 1337 | |
| Comparative Example 56 | 1-5 | 500 | 2 | 1.34 | 1316 | |
| Comparative Example 57 | 1-5 | 500 | 4 | 1.33 | 1304 | |
| Comparative Example 58 | 1-5 | 500 | 8 | 1.32 | 1238 | |
| Comparative Example 59 | 1-5 | 550 | 2 | 1.34 | 1217 | |

Figure 2:
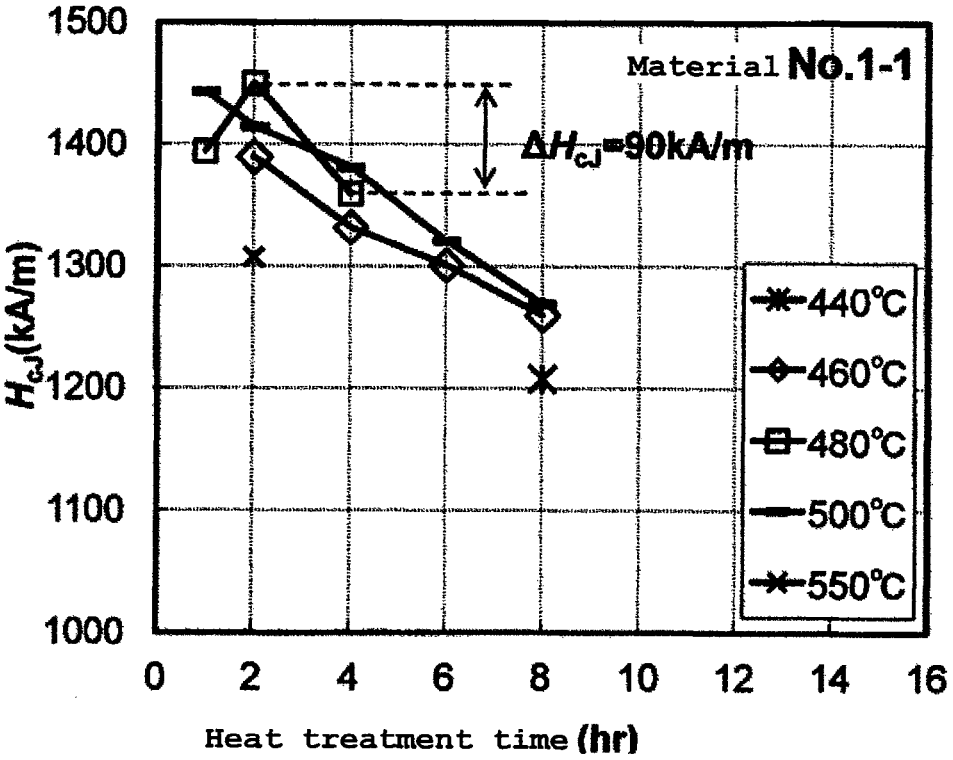
FIG. 2 is an explanatory diagram showing the relationship between $H_{cJ}$ of an R-T-B based sintered magnet of specimen No. 1-1 and the heat treatment time.

In the R-T-B based sintered magnets (materials No. 1-2, 1-3, 1-4, and 1-5) that satisfied the composition condition required by the present invention, as shown in Tables 3 to 6, the fluctuation range of $H_{cJ}$ was in a range of 17 to 57 kA/m, i.e. less than 60 kA/m, at the heat treatment time and heat treatment temperature specified by the present invention. Note that as mentioned above, the fluctuation range of $H_{cJ}$ in each of Tables 3 to 6 was determined by setting the optimal temperature at which the $H_{cJ}$ was the highest as the standard. However, even at other heat treatment temperatures and other heat treatment times in the present invention, the fluctuation range of $H_{cJ}$ was less than 60 kA/m. (For example, in Examples 4 to 6 (450° C.), the fluctuation range of $H_{cJ}$ was 20 kA/m, while in Examples 10 to 13 (470° C.), the fluctuation range of $H_{cJ}$ was 52 kA/m.) In contrast, as shown in Table 2, in the R-T-B based sintered magnet (material No. 1-1) in which the Cu content deviated from the composition range required by the present invention, the fluctuation range of $H_{cJ}$ was 90 kA/m, i.e. exceeded 60 kA/m even at the heat treatment temperature and heat treatment time specified by the present invention. As shown in Tables 3 to 6, even if the composition condition of the present invention was satisfied, when the heat treatment temperature deviated from that specified by the present invention, the $H_{cJ}$ was reduced for the heat treatment time exceeding 2 hours. Note that even if the heat treatment temperature deviated from that specified by the present invention, when the heat treatment time was 2 hours or less (for example, in Comparative Example 18 of Table 3, and in Comparative Example 31 of Table 4), the high $H_{cJ}$ could be obtained. However, because of its extremely short heat treatment time, when using the heat treatment furnace having a large-sized capacity commonly used in the production facility, the magnetic properties of the R-T-B based sintered magnet are considered to vary significantly depending on the mounted position in the furnace. Furthermore, as a postscript, the relationship between the heat treatment times shown in Tables 4 and 2 and the $H_{cJ}$ will be shown in FIGS. 1 and 2. As shown in FIG. 2, in the material No. 1-1 in which the Cu content deviated from the composition range required by the present invention, the fluctuation range of $H_{cJ}$ became large. When the heat treatment time exceeded 2 hours even at any heat treatment temperature, the $H_{cJ}$ was drastically decreased. In contrast, as shown in FIG. 1, the composition of the sintered magnet material satisfying the conditions of the present invention (material No. 1-3) suppressed the fluctuation range of $H_{cJ}$. Further in the temperature range specified by the present invention (450° C. to 470° C.), the high $H_{cJ}$ was achieved.

Test Example 2

An Nd metal, a Pr metal, an electrolytic Co, an Al metal, a Cu metal, a Ga metal, an electrolytic iron (each of these metals having a purity of 99% or more), and a ferro-boron alloy were blended in such a manner as to have a sintered composition shown in Table 7, then fabricating rough pulverized powder in the same way as in Test Example 1. Then, 0.04% by mass of zinc stearate was added as a lubricant and mixed into 100% by mass of the rough pulverized powder obtained, followed by dry pulverization under a gas flow of nitrogen gas using the gas flow pulverizer (jet mill device), thereby producing fine pulverized powder (alloy powder) having a grain size $D_{50}$ of 4.0 to 4.6 μm. At this time, the oxygen concentration in the nitrogen gas during the pulverization was controlled to set the amount of oxygen in the sintered magnet finally obtained to around 0.1% by mass. Note that the grain size $D_{50}$ is a volume-center value (volume-based median diameter) obtained by measurement using the gasflow dispersion laser diffraction method.

The fine pulverized powder was molded and sintered in the same way as in Test Example 1, thereby producing an R-T-B based sintered magnet material. The density of the R-T-B based sintered magnet material was 7.5 $Mg/m^3$ or more. The analysis of the contents of respective components of the obtained R-T-B based sintered magnet material as well as the gas analysis (O (oxygen), N (nitrogen), and C (carbon)) were performed in the same way as in Test Example 1. The results of the analysis are shown in Table 7.

TABLE 7

| Material | Component [% by mass] | | | | | | | | | | | Oxygen-Nitrogen-Carbon [% by mass] | | | Calculated value |
|---|---|---|---|---|---|---|---|---|---|---|---|---|---|---|---|
| No. | Nd | Pr | R u | B w | Ga x | Cu y | Al z | Nb | Zr | Co | Fe | O | N | C | p |
| 2-1 | 23.4 | 7.7 | 31.1 | 0.91 | 0.2 | 0.10 | 0.30 | 0.00 | 0.00 | 0.51 | 66.4 | 0.10 | 0.04 | 0.10 | −0.015 |
| 2-2 | 23.4 | 7.7 | 31.1 | 0.91 | 0.2 | 0.31 | 0.30 | 0.00 | 0.00 | 0.51 | 66.4 | 0.11 | 0.05 | 0.09 | −0.015 |
| 2-3 | 23.3 | 7.7 | 31.0 | 0.91 | 0.2 | 0.51 | 0.30 | 0.00 | 0.00 | 0.50 | 66.3 | 0.10 | 0.04 | 0.09 | −0.017 |
| 2-4 | 23.3 | 7.7 | 30.9 | 0.91 | 0.2 | 0.73 | 0.29 | 0.00 | 0.00 | 0.51 | 66.1 | 0.10 | 0.04 | 0.09 | −0.011 |
| 2-5 | 23.1 | 7.6 | 30.8 | 0.90 | 0.2 | 1.00 | 0.29 | 0.00 | 0.00 | 0.50 | 66.0 | 0.10 | 0.04 | 0.09 | −0.021 |

The obtained R-T-B based sintered magnet material was heated, held at 800° C. for 2 hours in vacuum, and then cooled to the room temperature. Then, the R-T-B based sintered magnet material was subjected to a heat treatment on the conditions mentioned in one of Tables 8 to 12 in vacuum, and subsequently cooled to the room temperature. That is, a material No. 2-1 was subjected to the heat treatment under the heat treatment conditions (heat treatment temperature, heat treatment time) shown in Table 8; and materials No. 2-2 to 2-5 were subjected in the same way under the heat treatment conditions shown in Tables 9 to 12, respectively. At this time, the heat treatment on the conditions mentioned in Tables 8 to 12 was performed in a heat treatment furnace for experiments having a small capacity, so that delay of the specimen's temperature hardly occurred during the increase in temperature. Thus, the heat treatment time mentioned in the tables corresponds to a time during which the R-T-B based sintered magnet material was actually held at the heat treatment temperature. Thereafter, the $B_r$ and $H_{cJ}$ of the R-T-B based sintered magnet after the heat treatment were measured in the same way as in Test Example 1. It was analyzed and confirmed by the high-frequency inductively coupled plasma optical emission spectrometry (ICP-OES) method that the composition of the R-T-B based sintered magnet obtained after the heat treatment was the same (substantially the same) as the composition of the R-T-B based sintered material shown in Table 7. Furthermore, the fluctuation range of $H_{cJ}$ was evaluated in the same way as in Test Example 1. The measurement results and the fluctuation range ($\Delta H_{cJ}$) of $H_{cJ}$ are shown in Tables 8 to 12.

TABLE 8

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 60 | 2-1 | 440 | 8 | 1.37 | 1150 | |
| Comparative Example 61 | 2-1 | 460 | 2 | 1.37 | 1304 | |
| Comparative Example 62 | 2-1 | 460 | 4 | 1.37 | 1234 | |
| Comparative Example 63 | 2-1 | 480 | 1 | 1.36 | 1318 | |
| Comparative Example 64 | 2-1 | 480 | 2 | 1.37 | 1333 | |
| Comparative Example 65 | 2-1 | 480 | 4 | 1.36 | 1311 | |
| Comparative Example 66 | 2-1 | 500 | 1 | 1.37 | 1333 | |
| Comparative Example 67 | 2-1 | 500 | 2 | 1.37 | 1354 | 68 |
| Comparative Example 68 | 2-1 | 500 | 4 | 1.36 | 1286 | |

TABLE 9

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 69 | 2-2 | 440 | 8 | 1.37 | 1251 | |
| Comparative Example 70 | 2-2 | 460 | 2 | 1.37 | 1296 | |
| Example 26 | 2-2 | 460 | 4 | 1.36 | 1344 | 33 |
| Example 27 | 2-2 | 460 | 6 | 1.36 | 1339 | |
| Example 31 | 2-2 | 460 | 8 | 1.37 | 1311 | |
| Comparative Example 71 | 2-2 | 480 | 1 | 1.37 | 1225 | |
| Comparative Example 72 | 2-2 | 480 | 2 | 1.37 | 1335 | |
| Comparative Example 73 | 2-2 | 480 | 4 | 1.37 | 1289 | |
| Comparative Example 74 | 2-2 | 500 | 1 | 1.37 | 1224 | |
| Comparative Example 75 | 2-2 | 500 | 2 | 1.37 | 1307 | |
| Comparative Example 76 | 2-2 | 500 | 4 | 1.36 | 1229 | |

TABLE 10

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 77 | 2-3 | 440 | 8 | 1.36 | 1267 | |
| Example 28 | 2-3 | 450 | 4 | 1.36 | 1296 | |
| Comparative Example 78 | 2-3 | 460 | 2 | 1.36 | 1324 | |
| Example 29 | 2-3 | 460 | 4 | 1.35 | 1325 | 19 |
| Example 30 | 2-3 | 460 | 6 | 1.35 | 1310 | |
| Example 31 | 2-3 | 460 | 8 | 1.36 | 1306 | |
| Example 32 | 2-3 | 470 | 4 | 1.36 | 1302 | |
| Comparative Example 79 | 2-3 | 480 | 1 | 1.36 | 1244 | |
| Comparative Example 80 | 2-3 | 480 | 2 | 1.36 | 1298 | |
| Comparative Example 81 | 2-3 | 480 | 4 | 1.36 | 1276 | |
| Comparative Example 82 | 2-3 | 500 | 1 | 1.36 | 1251 | |
| Comparative Example 83 | 2-3 | 500 | 2 | 1.36 | 1278 | |
| Comparative Example 84 | 2-3 | 500 | 4 | 1.35 | 1224 | |

TABLE 11

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 85 | 2-4 | 440 | 8 | 1.36 | 1206 | |
| Comparative Example 86 | 2-4 | 460 | 2 | 1.36 | 1228 | |
| Example 33 | 2-4 | 460 | 4 | 1.35 | 1337 | |
| Example 34 | 2-4 | 460 | 6 | 1.35 | 1344 | 6 |
| Example 35 | 2-4 | 460 | 8 | 1.35 | 1338 | |
| Comparative Example 87 | 2-4 | 480 | 1 | 1.36 | 1212 | |
| Comparative Example 88 | 2-4 | 480 | 2 | 1.36 | 1261 | |
| Comparative Example 89 | 2-4 | 480 | 4 | 1.35 | 1246 | |
| Comparative Example 90 | 2-4 | 500 | 1 | 1.36 | 1221 | |
| Comparative Example 91 | 2-4 | 500 | 2 | 1.36 | 1262 | |
| Comparative Example 92 | 2-4 | 500 | 4 | 1.35 | 1220 | |

TABLE 12

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 93 | 2-5 | 440 | 8 | 1.35 | 1084 | |
| Comparative Example 94 | 2-5 | 460 | 2 | 1.35 | 1189 | |
| Example 36 | 2-5 | 460 | 4 | 1.33 | 1346 | 12 |
| Example 37 | 2-5 | 460 | 6 | 1.34 | 1335 | |
| Example 38 | 2-5 | 460 | 8 | 1.34 | 1334 | |
| Comparative Example 95 | 2-5 | 480 | 1 | 1.35 | 1197 | |
| Comparative Example 96 | 2-5 | 480 | 2 | 1.35 | 1262 | |
| Comparative Example 97 | 2-5 | 480 | 4 | 1.34 | 1271 | |
| Comparative Example 98 | 2-5 | 500 | 1 | 1.34 | 1184 | |
| Comparative Example 99 | 2-5 | 500 | 2 | 1.35 | 1225 | |
| Comparative Example 100 | 2-5 | 500 | 4 | 1.34 | 1202 | |

As shown in Tables 9 to 12, in the R-T-B based sintered magnets (materials No. 2-2, 2-3, 2-4, and 2-5) that satisfied the composition condition required by the present invention, the fluctuation range of $H_{cJ}$ was in a range of 6 to 33 kA/m, i.e. less than 60 kA/m, at the heat treatment time and heat treatment temperature specified by the present invention. In contrast, as shown in Table 8, in the R-T-B based sintered magnet (material No. 2-1) in which the Cu content deviated from the composition range required by the present invention, the fluctuation range of $H_{cJ}$ was 68 kA/m, i.e. exceeded 60 kA/m. As shown in Tables 9 to 12, even if the composition condition of the present invention was satisfied, when the heat treatment temperature deviated from that specified by the present invention, the $H_{cJ}$ was reduced for the heat treatment time exceeding 2 hours.

Test Example 3

An Nd metal, a Pr metal, an electrolytic Co, an Al metal, a Cu metal, a Ga metal, an electrolytic iron (each of these metals having a purity of 99% or more), and a ferro-boron alloy were blended in such a manner as to have a sintered composition shown in Table 13, then fabricating rough pulverized powder in the same way as in Test Example 1. Then, 0.04% by mass of zinc stearate was added as a lubricant and mixed into 100% by mass of the rough pulverized powder obtained, followed by dry pulverization under a gas flow of nitrogen gas using the gas flow pulverizer (jet mill device), thereby producing fine pulverized powder (alloy powder) having a grain size $D_{50}$ of 4.1 to 4.7 μm. At this time, the oxygen concentration in the nitrogen gas during the pulverization was controlled to set the amount of oxygen in the sintered magnet finally obtained to around 0.1% by mass. Note that the grain size $D_{50}$ is a volume-center value (volume-based median diameter) obtained by measurement using the gas flow dispersion laser diffraction method.

The fine pulverized powder was molded and sintered in the same way as in Test Example 1, thereby producing an R-T-B based sintered magnet material. The density of the R-T-B based sintered magnet material was 7.5 $Mg/m^3$ or more. The analysis of the contents of respective components of the obtained R-T-B based sintered magnet material as well as the gas analysis (O (oxygen), N (nitrogen), and C (carbon)) were performed in the same way as in Test Example 1. The results of the analysis are shown in Table 13.

TABLE 13

| Material | Component [% by mass] | | | | | | | | | | | Oxygen-Nitrogen-Carbon [% by mass] | | | Calculated value |
|---|---|---|---|---|---|---|---|---|---|---|---|---|---|---|---|
| No. | Nd | Pr | R u | B w | Ga x | Cu y | Al z | Nb | Zr | Co | Fe | O | N | C | p |
| 3-1 | 23.2 | 7.7 | 30.9 | 0.89 | 1.0 | 0.10 | 0.29 | 0.00 | 0.00 | 0.50 | 64.9 | 0.09 | 0.04 | 0.09 | −0.018 |
| 3-2 | 23.1 | 7.6 | 30.7 | 0.89 | 1.0 | 0.30 | 0.29 | 0.00 | 0.00 | 0.50 | 64.9 | 0.10 | 0.04 | 0.10 | −0.018 |
| 3-3 | 23.1 | 7.6 | 30.7 | 0.88 | 1.0 | 0.50 | 0.29 | 0.00 | 0.00 | 0.51 | 64.8 | 0.09 | 0.05 | 0.09 | −0.029 |
| 3-4 | 23.0 | 7.6 | 30.6 | 0.88 | 1.0 | 0.69 | 0.29 | 0.00 | 0.00 | 0.50 | 64.7 | 0.10 | 0.05 | 0.09 | −0.027 |
| 3-5 | 23.0 | 7.6 | 30.6 | 0.86 | 1.0 | 1.00 | 0.30 | 0.00 | 0.00 | 0.50 | 64.3 | 0.10 | 0.05 | 0.09 | −0.046 |

The obtained R-T-B based sintered magnet material was heated, held at 800° C. for 2 hours in vacuum, and then cooled to the room temperature. Then, the R-T-B based sintered magnet material was subjected to a heat treatment on the conditions mentioned in one of Tables 14 to 18 in vacuum, and subsequently cooled to the room temperature. That is, a material No. 3-1 was subjected to the heat treatment under the heat treatment conditions (heat treatment temperature, heat treatment time) shown in Table 14; and materials No. 3-2 to 3-5 were subjected in the same way under the heat treatment conditions shown in Tables 15 to 18, respectively. At this time, the heat treatment on the conditions mentioned in Tables 14 to 18 was performed in a heat treatment furnace for experiments having a small capacity, so that delay of the specimen's temperature hardly occurred during the increase in temperature. Thus, the heat treatment time mentioned in the tables corresponds to a time during which the R-T-B based sintered magnet material was actually held at the heat treatment temperature. Thereafter, the $B_r$ and $H_{cJ}$ of the R-T-B based sintered magnet after the heat treatment were measured in the same way as in Test Example 1. It was analyzed and confirmed by the high-frequency inductively coupled plasma optical emission spectrometry (ICP-OES) method that the composition of the R-T-B based sintered magnet obtained after the heat treatment was the same (substantially the same) as the composition of the R-T-B based sintered material shown in Table 13. Furthermore, the fluctuation range of $H_{cJ}$ was measured in the same way as in Test Example 1. The results of measurements and the fluctuation range of $H_{cJ}$ ($\Delta H_{cJ}$) are shown in Tables 14 to 18.

TABLE 14

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 101 | 3-1 | 440 | 2 | 1.35 | 1127 | |
| Comparative Example 102 | 3-1 | 460 | 2 | 1.35 | 1164 | |
| Comparative Example 103 | 3-1 | 460 | 4 | 1.34 | 1137 | |
| Comparative Example 104 | 3-1 | 460 | 8 | 1.34 | 1074 | |
| Comparative Example 105 | 3-1 | 460 | 16 | 1.35 | 1042 | |
| Comparative Example 106 | 3-1 | 480 | 1 | 1.35 | 1303 | 102 |
| Comparative Example 107 | 3-1 | 480 | 2 | 1.34 | 1233 | |
| Comparative Example 108 | 3-1 | 480 | 3 | 1.34 | 1201 | |
| Comparative Example 109 | 3-1 | 480 | 4 | 1.34 | 1167 | |
| Comparative Example 110 | 3-1 | 500 | 2 | 1.34 | 1302 | |

TABLE 15

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 111 | 3-2 | 440 | 2 | 1.34 | 1097 | |
| Comparative Example 112 | 3-2 | 460 | 2 | 1.34 | 1365 | |
| Example 39 | 3-2 | 460 | 4 | 1.34 | 1378 | 49 |
| Example 40 | 3-2 | 460 | 6 | 1.34 | 1356 | |
| Example 41 | 3-2 | 460 | 8 | 1.33 | 1329 | |
| Comparative Example 113 | 3-2 | 460 | 16 | 1.33 | 1303 | |
| Comparative Example 114 | 3-2 | 480 | 1 | 1.34 | 1309 | |
| Comparative Example 115 | 3-2 | 480 | 2 | 1.34 | 1370 | |
| Comparative Example 116 | 3-2 | 480 | 4 | 1.33 | 1356 | |
| Comparative Example 117 | 3-2 | 500 | 2 | 1.34 | 1346 | |

TABLE 16

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 118 | 3-3 | 440 | 2 | 1.34 | 1044 | |
| Example 42 | 3-3 | 450 | 4 | 1.34 | 1322 | |
| Comparative Example 119 | 3-3 | 460 | 2 | 1.34 | 1327 | |
| Example 43 | 3-3 | 460 | 4 | 1.33 | 1355 | 13 |
| Example 44 | 3-3 | 460 | 6 | 1.33 | 1368 | |
| Example 45 | 3-3 | 460 | 8 | 1.33 | 1365 | |
| Comparative Example 120 | 3-3 | 460 | 16 | 1.33 | 1327 | |
| Example 46 | 3-3 | 470 | 4 | 1.33 | 1338 | |
| Comparative Example 121 | 3-3 | 480 | 1 | 1.34 | 1246 | |
| Comparative Example 122 | 3-3 | 480 | 2 | 1.34 | 1329 | |
| Comparative Example 123 | 3-3 | 480 | 4 | 1.33 | 1331 | |
| Comparative Example 124 | 3-3 | 500 | 2 | 1.34 | 1306 | |

TABLE 17

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 125 | 3-4 | 440 | 2 | 1.33 | 1044 | |
| Comparative Example 126 | 3-4 | 460 | 2 | 1.33 | 1332 | |
| Example 47 | 3-4 | 460 | 4 | 1.32 | 1363 | 8 |
| Example 48 | 3-4 | 460 | 6 | 1.32 | 1371 | |
| Example 49 | 3-4 | 460 | 8 | 1.32 | 1364 | |
| Comparative Example 127 | 3-4 | 460 | 16 | 1.32 | 1347 | |
| Comparative Example 128 | 3-4 | 480 | 1 | 1.33 | 1257 | |
| Comparative Example 129 | 3-4 | 480 | 2 | 1.33 | 1318 | |
| Comparative Example 130 | 3-4 | 480 | 4 | 1.32 | 1353 | |
| Comparative Example 131 | 3-4 | 500 | 2 | 1.33 | 1320 | |

TABLE 18

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 132 | 3-5 | 440 | 2 | 1.31 | 965 | |
| Comparative Example 133 | 3-5 | 460 | 2 | 1.33 | 1282 | |

TABLE 18-continued

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Example 50 | 3-5 | 460 | 4 | 1.32 | 1324 | 29 |
| Example 51 | 3-5 | 460 | 6 | 1.31 | 1353 | |
| Example 52 | 3-5 | 460 | 8 | 1.31 | 1341 | |
| Comparative Example 134 | 3-5 | 460 | 16 | 1.32 | 1319 | |
| Comparative Example 135 | 3-5 | 480 | 1 | 1.32 | 1210 | |
| Comparative Example 136 | 3-5 | 480 | 2 | 1.32 | 1278 | |
| Comparative Example 137 | 3-5 | 480 | 4 | 1.32 | 1317 | |
| Comparative Example 138 | 3-5 | 500 | 2 | 1.32 | 1293 | |

As shown in Tables 15 to 18, in the R-T-B based sintered magnets (materials No. 3-2, 3-3, 3-4, and 3-5) that satisfied the composition condition required by the present invention, the fluctuation range of $H_{cJ}$ was in a range of 8 to 49 kA/m, i.e. less than 60 kA/m, at the heat treatment time and heat treatment temperature specified by the present invention. In contrast, as shown in Table 14, in the R-T-B based sintered magnet (material No. 3-1) in which the Cu content deviated from the composition range required by the present invention, the fluctuation range of $H_{cJ}$ was 102 kA/m, i.e. exceeded 60 kA/m. Further, as shown in Tables 15 to 18, even if the composition condition of the present invention was satisfied, when the heat treatment temperature deviated from that specified by the present invention, the $H_{cJ}$ was reduced for the heat treatment time exceeding 2 hours.

Test Example 4

An Nd metal, a Pr metal, an electrolytic Co, an Al metal, a Cu metal, a Ga metal, an electrolytic iron (each of these metals having a purity of 99% or more), a ferro-boron alloy, a ferro-niobium alloy, and a ferro-zirconium alloy were blended in such a manner as to have a sintered composition shown in Table 19, then fabricating rough pulverized powder in the same way as in Test Example 1. Then, 0.04% by mass of zinc stearate was added as a lubricant and mixed into 100% by mass of the rough pulverized powder obtained, followed by dry pulverization under a gas flow of nitrogen gas using the gas flow pulverizer (jet mill device), thereby producing fine pulverized powder (alloy powder) having a grain size $D_{50}$ of 4.0 to 4.5 μm. At this time, the oxygen concentration in the nitrogen gas during the pulverization was controlled to set the amount of oxygen in the sintered magnet finally obtained to around 0.1% by mass. Note that the grain size $D_{50}$ is a volume-center value (volume-based median diameter) obtained by measurement using the gas flow dispersion laser diffraction method.

The fine pulverized powder was molded and sintered in the same way as in Test Example 1, thereby producing an R-T-B based sintered magnet material. The density of the R-T-B based sintered magnet material was 7.5 $Mg/m^3$ or more. The analysis of the contents of respective components of the obtained R-T-B based sintered magnet material as well as the gas analysis (O (oxygen), N (nitrogen), and C (carbon)) were performed in the same way as in Test Example 1. The results of the analysis are shown in Table 19.

TABLE 19

| Material | Component [% by mass] | | | | | | | | | | | Oxygen-Nitrogen-Carbon [% by mass] | | | Calculated value |
|---|---|---|---|---|---|---|---|---|---|---|---|---|---|---|---|
| No. | Nd | Pr | R u | B w | Ga x | Cu y | Al z | Nb | Zr | Co | Fe | O | N | C | p |
| 4-1 | 21.8 | 7.2 | 28.9 | 0.87 | 0.3 | 0.50 | 0.49 | 0.00 | 0.00 | 0.50 | 67.0 | 0.10 | 0.05 | 0.09 | −0.082 |
| 4-2 | 23.2 | 7.7 | 30.9 | 0.85 | 0.3 | 0.50 | 0.51 | 0.00 | 0.00 | 0.50 | 65.7 | 0.10 | 0.05 | 0.10 | −0.084 |
| 4-3 | 22.2 | 7.3 | 29.5 | 0.88 | 0.3 | 0.51 | 0.50 | 0.05 | 0.05 | 0.51 | 66.6 | 0.09 | 0.05 | 0.09 | −0.062 |
| 4-4 | 23.3 | 7.7 | 30.9 | 0.90 | 0.1 | 0.51 | 0.30 | 0.00 | 0.00 | 0.50 | 65.5 | 0.10 | 0.04 | 0.10 | −0.016 |
| 4-5 | 23.3 | 7.7 | 30.9 | 0.89 | 1.5 | 0.50 | 0.29 | 0.00 | 0.00 | 0.50 | 64.2 | 0.10 | 0.05 | 0.10 | −0.006 |

The obtained R-T-B based sintered magnet material was heated, held at 800° C. for 2 hours in vacuum, and then cooled to the room temperature. Then, the R-T-B based sintered magnet material was subjected to a heat treatment on the conditions mentioned in one of Tables 20 to 24 in vacuum, and subsequently cooled to the room temperature. That is, a material No. 4-1 was subjected to the heat treatment under the heat treatment conditions (heat treatment temperature, heat treatment time) shown in Table 20; and likewise, materials No. 4-2 to 4-5 were subjected in the same way under the heat treatment conditions shown in Tables 21 to 24, respectively. At this time, the heat treatment on the conditions mentioned in Tables 20 to 24 was performed in a heat treatment furnace for experiments having a small capacity, so that delay of the specimen's temperature hardly occurred during the increase in temperature. Thus, the heat treatment time mentioned in the tables corresponds to a time during which the R-T-B based sintered magnet material was actually held at the heat treatment temperature. Thereafter, the $B_r$ and $H_{cJ}$ of the R-T-B based sintered magnet after the heat treatment were measured in the same way as in Test Example 1. It was analyzed and confirmed by the high-frequency inductively coupled plasma optical emission spectrometry (ICP-OES) method that the composition of the R-T-B based sintered magnet obtained after the heat treatment was the same (substantially the same) as the composition of the R-T-B based sintered material shown in Table 19. Furthermore, the fluctuation range of $H_{cJ}$ was measured in the same way as in Test Example 1. The results of measurements and the fluctuation range of $H_{cJ}$ are shown in Tables 20 to 24.

TABLE 20

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 139 | 4-1 | 440 | 2 | 1.37 | 1127 | |
| Comparative Example 140 | 4-1 | 460 | 2 | 1.37 | 1164 | |
| Comparative Example 141 | 4-1 | 460 | 4 | 1.36 | 1222 | 33 |
| Comparative Example 142 | 4-1 | 460 | 6 | 1.36 | 1255 | |
| Comparative Example 143 | 4-1 | 460 | 8 | 1.36 | 1251 | |
| Comparative Example 144 | 4-1 | 460 | 16 | 1.36 | 1238 | |
| Comparative Example 145 | 4-1 | 480 | 1 | 1.37 | 1244 | |
| Comparative Example 146 | 4-1 | 480 | 2 | 1.36 | 1199 | |
| Comparative Example 147 | 4-1 | 480 | 4 | 1.36 | 1141 | |
| Comparative Example 148 | 4-1 | 500 | 2 | 1.36 | 1246 | |

TABLE 21

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 149 | 4-2 | 440 | 2 | 1.31 | 1099 | |
| Comparative Example 150 | 4-2 | 460 | 2 | 1.30 | 1201 | |
| Comparative Example 151 | 4-2 | 460 | 4 | 1.30 | 1234 | 31 |
| Comparative Example 152 | 4-2 | 460 | 6 | 1.30 | 1265 | |
| Comparative Example 153 | 4-2 | 460 | 8 | 1.29 | 1249 | |
| Comparative Example 154 | 4-2 | 460 | 16 | 1.30 | 1233 | |
| Comparative Example 155 | 4-2 | 480 | 1 | 1.30 | 1200 | |
| Comparative Example 156 | 4-2 | 480 | 2 | 1.30 | 1245 | |
| Comparative Example 157 | 4-2 | 480 | 4 | 1.30 | 1157 | |
| Comparative Example 158 | 4-2 | 500 | 2 | 1.30 | 1251 | |

TABLE 22

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 159 | 4-3 | 440 | 2 | 1.36 | 1055 | |
| Example 53 | 4-3 | 450 | 4 | 1.36 | 1341 | |
| Comparative Example 160 | 4-3 | 460 | 2 | 1.36 | 1298 | |
| Example 54 | 4-3 | 460 | 4 | 1.36 | 1376 | 15 |
| Example 55 | 4-3 | 460 | 6 | 1.36 | 1391 | |
| Example 56 | 4-3 | 460 | 8 | 1.36 | 1387 | |
| Comparative Example 161 | 4-3 | 460 | 16 | 1.35 | 1364 | |
| Example 57 | 4-3 | 470 | 4 | 1.35 | 1377 | |
| Comparative Example 162 | 4-3 | 480 | 1 | 1.36 | 1297 | |
| Comparative Example 163 | 4-3 | 480 | 2 | 1.36 | 1377 | |
| Comparative Example 164 | 4-3 | 480 | 4 | 1.36 | 1355 | |
| Comparative Example 165 | 4-3 | 500 | 2 | 1.36 | 1322 | |

TABLE 23

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 166 | 4-4 | 440 | 2 | 1.37 | 1011 | |
| Comparative Example 167 | 4-4 | 460 | 2 | 1.37 | 1187 | |
| Comparative Example 168 | 4-4 | 460 | 4 | 1.37 | 1272 | 34 |
| Comparative Example 169 | 4-4 | 460 | 6 | 1.36 | 1255 | |
| Comparative Example 170 | 4-4 | 460 | 8 | 1.36 | 1238 | |
| Comparative Example 171 | 4-4 | 460 | 16 | 1.36 | 1245 | |
| Comparative Example 172 | 4-4 | 480 | 1 | 1.37 | 1190 | |
| Comparative Example 173 | 4-4 | 480 | 2 | 1.36 | 1235 | |
| Comparative Example 174 | 4-4 | 480 | 4 | 1.36 | 1201 | |
| Comparative Example 175 | 4-4 | 500 | 2 | 1.36 | 1266 | |

TABLE 24

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 176 | 4-5 | 440 | 2 | 1.31 | 1003 | |
| Comparative Example 177 | 4-5 | 460 | 2 | 1.30 | 1077 | |

TABLE 24-continued

| | Material No. | Heat treatment temperature [° C.] | Heat treatment time [Hour] | Br [T] | $H_{cJ}$ [kA/m] | $\Delta H_{cJ}$ [kA/m] |
|---|---|---|---|---|---|---|
| Comparative Example 178 | 4-5 | 460 | 6 | 1.29 | 1255 | 22 |
| Comparative Example 179 | 4-5 | 460 | 8 | 1.28 | 1233 | |
| Comparative Example 180 | 4-5 | 460 | 16 | 1.28 | 1231 | |
| Comparative Example 181 | 4-5 | 480 | 1 | 1.30 | 1100 | |
| Comparative Example 182 | 4-5 | 480 | 2 | 1.30 | 1201 | |
| Comparative Example 183 | 4-5 | 480 | 4 | 1.29 | 1239 | |
| Comparative Example 184 | 4-5 | 500 | 2 | 1.30 | 1192 | |

As shown in Table 22, in the R-T-B based sintered magnets (material No. 4-3) that satisfied the composition condition required by the present invention, the fluctuation range of $H_{cJ}$ was 15 kA/m, i.e. less than 60 kA/m, at the heat treatment time and heat treatment temperature specified by the present invention. In contrast, some R-T-B based sintered magnets had the features in which the R content, the B content, or the Ga content deviated from the composition range required by the present invention (specifically, in material No. 4-1, the R content deviated from the composition range of the present invention; in material No. 4-2, the B content deviated from the composition range of the present invention; in materials No. 4-4 and 4-5, the Ga content deviated from the composition range of the present invention). In these R-T-B based sintered magnets, the B content was set lower than that of the general R-T-B based sintered magnet (i.e. p satisfied the relation of p<0 when p=[B]/10.811×14−[Fe]/55.847−[Co]/58.933 (where [B], [Fe], and [Co] indicated the contents of B, Fe, and Co in percent by mass, respectively); and further the C content was set within the range specified by the present invention. In these cases, as shown in Tables 20, 21, 23, and 24, although the fluctuation range of $H_{cJ}$ was in a range of 15 to 34 kA/m, or 60 kA/m or less, the $H_{cJ}$ values were 1300 kA/m or less at all the heat treatment temperatures and for the heat treatment times, resulting in the degradation in $H_{cJ}$.

This application claims the benefit of priority to Japanese Patent Application No. 2014-063451 filed on Mar. 26, 2014, which is hereby incorporated by reference in its entirety.

INDUSTRIAL APPLICABILITY

The R-T-B based sintered magnet obtained in the present invention is suitable for use in various motors for hybrid automobiles, electric vehicles, home appliances, etc.

The invention claimed is:

1. A method for manufacturing an R-T-B based sintered magnet, which comprises the steps of:

preparing an R-T-B based sintered magnet material by molding and sintering alloy powder; and performing a heat treatment by heating the R-T-B based sintered magnet material at a temperature of 450° C. or higher and 470° C. or lower for 4 hours or more and 12 hours or less, wherein the R-T-B based sintered magnet material is represented by the formula of:

uRwBxGayCuzAlqM (100−u−w−x−y−z−q) T, where R is composed of a light rare-earth element RL and a heavy rare-earth element RH, in which RL is Nd and/or Pr, and RH is at least one element of Dy, Tb, Gd, and Ho; T is a transition metal element, indispensably containing Fe; and M is Nb and/or Zr, u, w, x, y, z, q, and 100−u−w−x−y−z−q are expressed in percent by mass, the content of RH is 5% or less by mass in the R-T-B based sintered magnet, $29.5 \leq u \leq 32.0$, $0.86 \leq w \leq 0.93$, $0.2 \leq x \leq 1.0$, $0.3 \leq y \leq 1.0$, $0.05 \leq z \leq 0.5$, $0 \leq q \leq 0.1$, and a relationship of p<0 is satisfied when p=[B]/10.811×14−[Fe]/55.847−[Co]/58.933, where [B], [Fe], and [Co] are contents of B, Fe, and Co in percent by mass, respectively, wherein a fluctuation range of $H_{cJ}$ is 60 kA/m or less, wherein in the range of the heat treatment temperature and the heat treatment time, an optimal temperature and time at which $H_{cJ}$ is the highest are defined as the standard, and in the range of the heat treatment time at the optimal temperature, a difference between the $H_{cJ}$ defined as the standard and the lowest $H_{cJ}$ is determined, and the difference is defined as the fluctuation range of $H_{cJ}$.

2. The method for manufacturing an R-T-B based sintered magnet according to claim 1, wherein x and y satisfy relationships below:

$0.3 \leq x \leq 0.7$, and $0.5 \leq y \leq 0.7$.

3. The method for manufacturing an R-T-B based sintered magnet according to claim 1, wherein the heat treatment step is performed by heating the R-T-B based sintered magnet material at a temperature of 450° C. or higher and 470° C. or lower for 4 hours or more and 8 hours or less.

4. The method for manufacturing an R-T-B based sintered magnet according to claim 2, wherein the heat treatment step is performed by heating the R-T-B based sintered magnet material at a temperature of 450° C. or higher and 470° C. or lower for 4 hours or more and 8 hours or less.

5. The method for manufacturing an R-T-B based sintered magnet according to claim 1, wherein the heat treatment is performed in a vacuum.

6. The method for manufacturing an R-T-B based sintered magnet according to claim 1, wherein the R-T-B based sintered magnet material does not contain any heavy rare-earth elements.

* * * * *